US005095980A

United States Patent [19]

Watson

[11] Patent Number: 5,095,980

[45] Date of Patent: Mar. 17, 1992

[54] NON-ROTATING CEMENTING PLUG WITH MOLDED INSERTS

[75] Inventor: Brock W. Watson, Duncan, Okla.

[73] Assignee: Halliburton Company, Duncan, Okla.

[21] Appl. No.: 656,545

[22] Filed: Feb. 15, 1991

[51] Int. Cl.[5] ..... E21B 33/16

[52] U.S. Cl. ..... 166/192; 166/153

[58] Field of Search ..... 166/153-156, 166/192-194, 202, 285, 315

[56] References Cited

U.S. PATENT DOCUMENTS 4,190,111 2/1980 Davis ..... 166/153 X 4,190,112 2/1980 Davis ..... 166/153 X

*Primary Examiner*—Thuy M. Bui

*Attorney, Agent, or Firm*—James R. Duzan

[57] ABSTRACT

An easily drillable non-metallic, non-rotating plug set for use in well cementing operations.

6 Claims, 6 Drawing Sheets

NON-ROTATING CEMENTING PLUG WITH MOLDED INSERTS

BACKGROUND OF THE INVENTION

This invention relates to an easily drillable, non-metallic, non-rotating plug set for use in well cementing operations.

Typically, at the beginning of the cementing job in rotary drilled wells, the casing and hole are filled with drilling mud. In many areas, to reduce contamination on the interface between the mud and cement a bottom plug is pumped ahead of the cement slurry. The bottom plug is typically constructed having five wipers of elastomeric material thereon to wipe the casing of drilling mud thereby separate the drilling mud from the cement slurry. When this plug reaches the float collar at the bottom of the casing string, a fluid pressure differential created across the plug ruptures a rubber diaphragm at the top of the plug and allows the cement slurry to proceed down the casing through the plug and floating equipment and up the annular space between the pipe and the well bore.

When all of the cement has been placed, a top cementing plug having typically five wipers thereon is released from the plug container. The top plug's function is to follow the cement and is designed to reduce the possibility of any contamination or channeling of the cement slurry with the drilling mud that is used to displace the cement column down the casing and into the annular space between the casing and the well bore. The top cementing plug is typically solid in construction and the design is such that when it reaches the bottom cementing plug at the float collar, the top cementing plug causes a shut off of fluids being pumped into the casing.

The landing of the top plug will lessen the possibility of any further displacement of the cement slurry and provides a better quality of cement slurry around the bottom of the casing where a good cement bond to the casing is required.

Typical prior art cementing plug sets which are used in well cementing operations have been constructed of wood, plastic or aluminum with an elastomeric covering thereon to form wipers which contact the well casing to be cemented in the well bore.

Previously, the plug set and the residual cement in the casing cemented in the well bore were removed by drilling operations using tooth type rock bits. The teeth on the rock bit proved effective in the drilling of the plug set, even though the individual plugs of the plug set were free to rotate with respect to each other and the floating equipment installed in the casing cemented in the well bore.

Recently, with the advent of polycrystalline diamond compact (PDC) drill bits to drill out the plug set and the residual cement in the casing cemented in the well bore it has become necessary to use a non-rotating plug set during the well casing cementing process to facilitate the drilling of the plug set, floating equipment and residual cement. For whatever reasons, the teeth on the PDC drill bit do not as effectively drill through the conventional plug set used in casing cementing operations as the conventional tooth-type rock bit. However, with the use of a non-rotating plug set in casing cementing operations, the PDC drill bit can drill through the plug set, floating equipment and residual cement in time periods comparable to that of conventional tooth-type rock bits.

STATEMENT OF THE INVENTION

The invention is an easily drillable, non-metallic, non-rotating plug set for use in well cementing operations. The present invention is directed to a set of cementing plugs comprised of non-metallic material having integrally formed teeth thereon to prevent rotating of the plug set during drilling operations.

The advantages of the present invention will be better understood by taking the following description of the invention in conjunction with the drawings.

DESCRIPTION OF THE INVENTION

Figure 1:
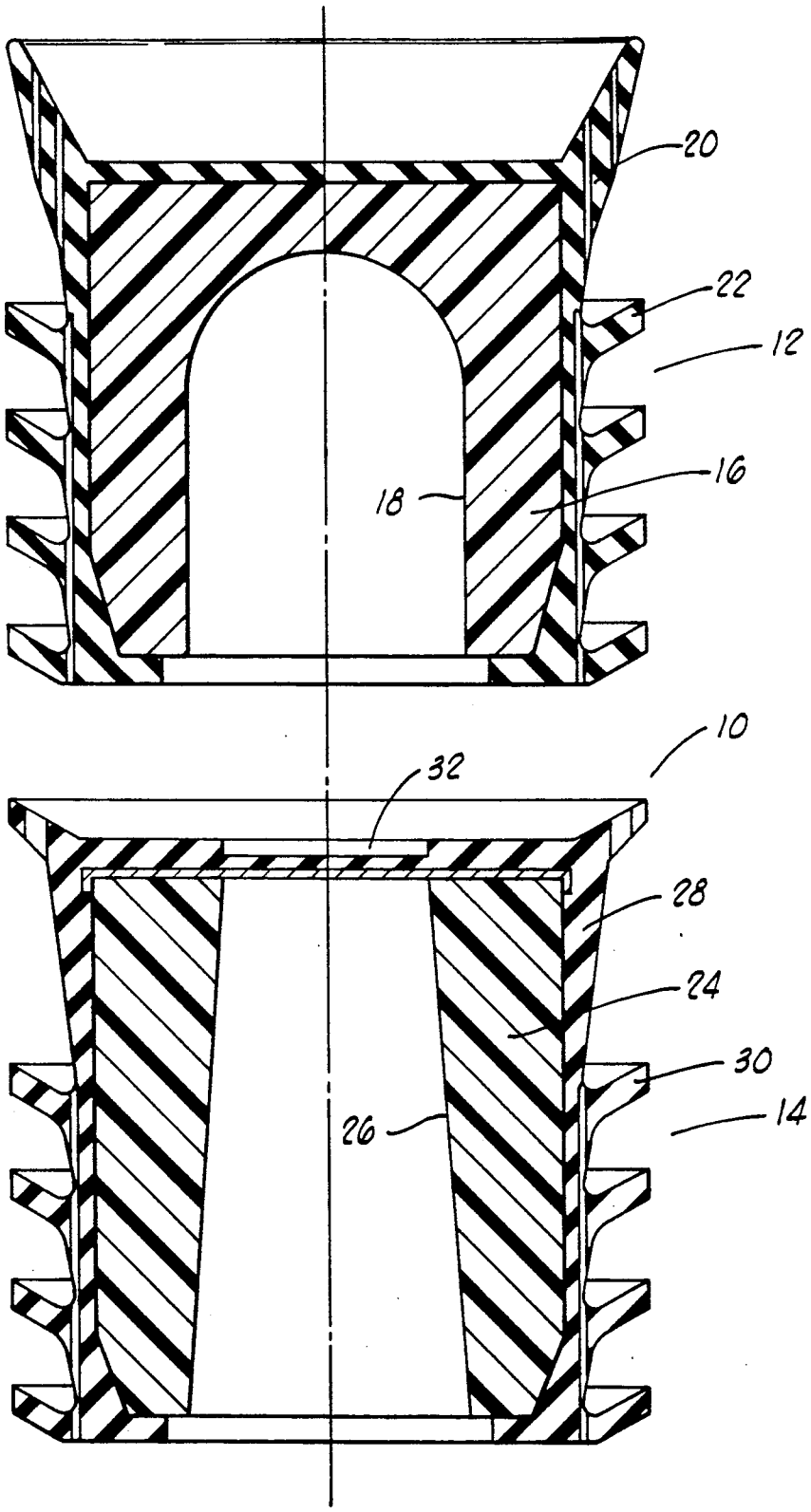
FIG. 1 PRIOR ART
FIG. 1 is a cross-sectional view of a prior art non-metallic plug set.

Referring to FIG. 1, a prior art non-metallic cementing plug set 10 is shown. The top plug 12 comprises a molded plastic body 16 having a central cavity 18 thereon and an elastomeric cover 20 thereon having a plurality of annular wipers 22. The bottom plug 14 comprises a molded plastic body 24 having a bore 26 therethrough and an elastomeric cover 28 thereon having a plurality of annular wipers 30 and diaphragm portion 32.

Figure 2:
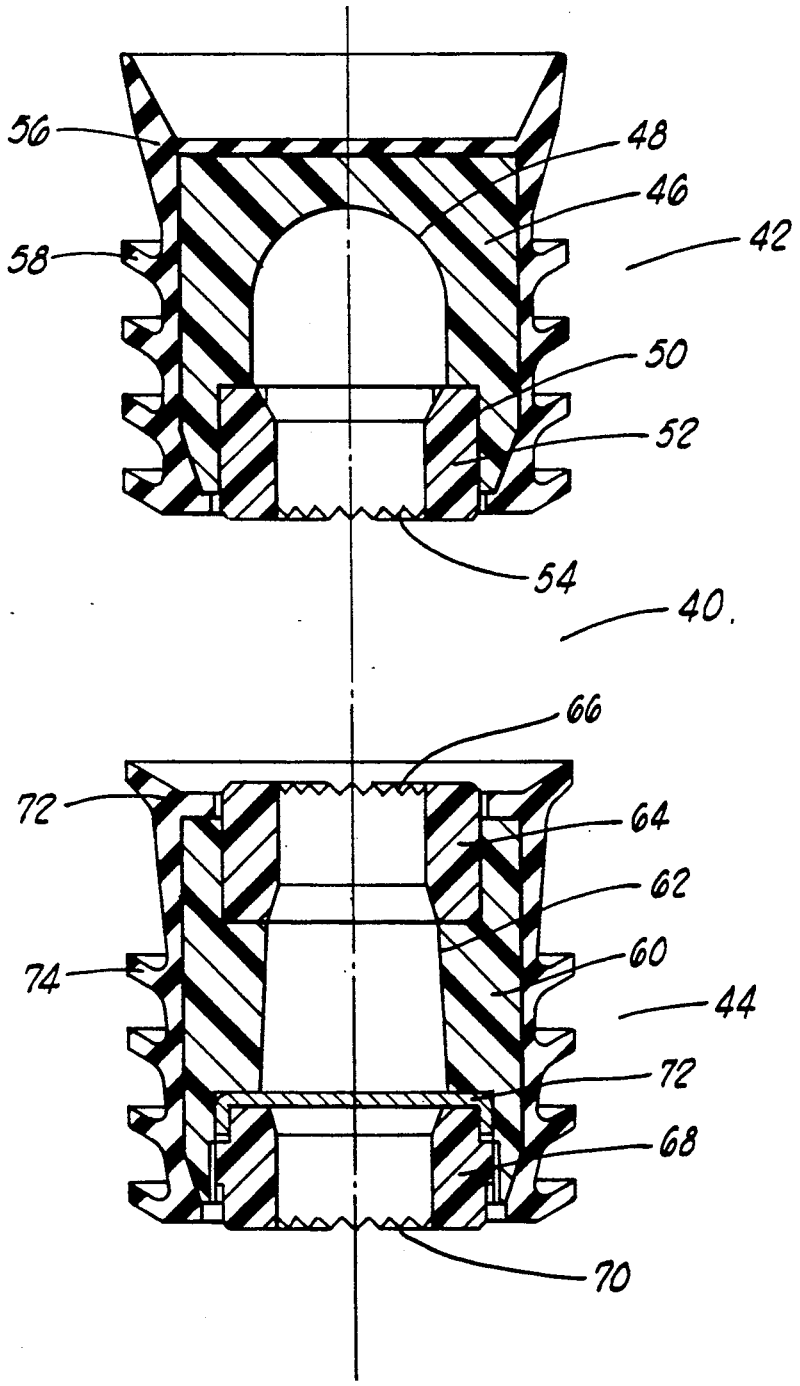
FIG. 2 PRIOR ART
FIG. 2 is a cross-sectional view of a prior art non-metallic, non-rotating plug set.

Referring to FIG. 2, a prior art non-metallic non-rotating plug set 40 is shown. The top plug 42 comprises a molded plastic body member 46 having a central cavity 48 therein and a bore 50 in the lower end, in which, an anti-rotation plastic insert 52 having teeth 54 thereon is retained by adhesive bonding of the insert 52 to the body member 46 and an elastomeric cover 56 having a plurality of wipers 58 thereon. The bottom plug 44 comprises a molded plastic body member 60 having a bore 62 therethrough having in turn, plastic anti-rotation upper insert 64 with teeth 66 thereon retained by adhesive bonding of the upper insert 64 to the body member 60 therein and plastic anti-rotation lower insert 68 with teeth 70 thereon retained by adhesive bonding of the lower insert 68 to the body member 60, elastomeric diaphragm 72 blocking fluid flow through bore 62, and an elastomeric cover 72 having a plurality of wipers 74 thereon.

The plug set 40 shown in FIG. 2 is described in detail in U.S. Pat. No. 4858687 which is incorporated herein by reference. The plug set 40 is also shown on pages 26 and 27 of Halliburton Sales & Service Catalog 44. Another prior art non rotating plug set, not shown in FIG. 2, is shown in U.S. Pat. No. 4,836,279.

Figure 3:
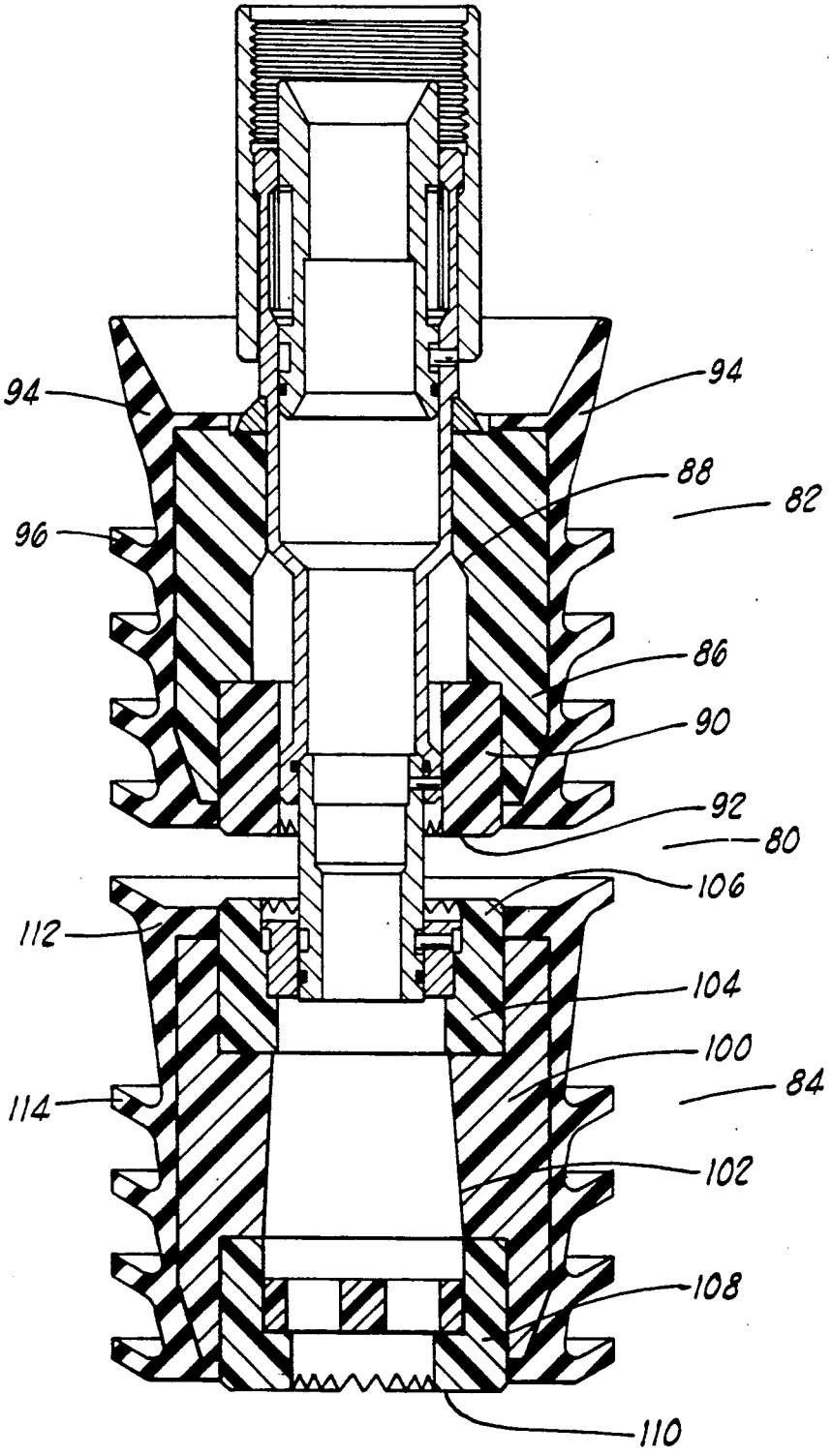
FIG. 3 PRIOR ART
FIG. 3 is a cross-sectional view of a prior art partially non-metallic, non-rotating plug set.

Referring to FIG. 3, a prior art non-metallic non-rotating sub-surface release (SSR) cementing plug set 80 is shown. The SSR plug set 80 shown in FIG. 3 is typically used in cementing operations as set forth on pages 28, 29 and 30 of Halliburton Sales and Service Catalog 44 which is incorporated herein by reference. The top plug 82 comprises a molded plastic body member 86 having a bore 88 therethrough, in which, an anti-rotation plastic insert 90 having teeth 92 thereon is retained by adhesive bonding of the insert 90 to the body member 86 and an elastomeric cover having a plurality of wipers 96 thereon. The bottom plug 84 comprises a molded plastic body member 100 having a bore 102 therethrough having, in turn, plastic anti-rotation upper insert 104 with teeth 106 thereon retained by adhesive bonding of the upper insert 104 to the body member 100 therein and plastic anti-rotation lower insert 108 with teeth 110 thereon to the body member 100 and elastomeric covering 112 having, in turn, a plurality of wipers 114 thereon.

Figure 4:
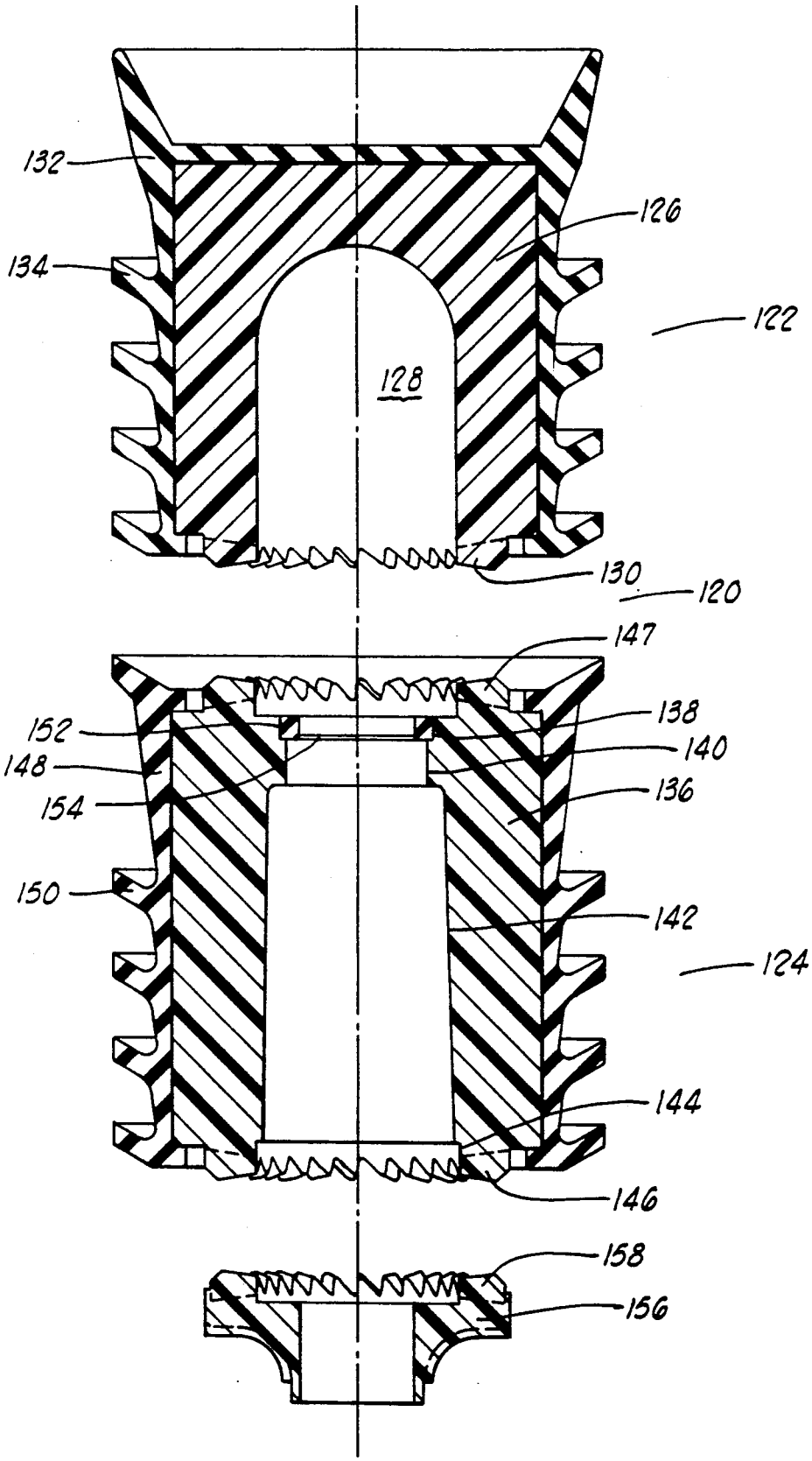
FIG. 4 is a cross-sectional view of one embodiment of the non-metallic, non-rotating plug set having integrally formed teeth thereon of the present invention.

Referring to FIG. 4, a first embodiment of the plug set 120 of the present invention is shown. The top plug 122 comprises non-metallic plastic body member 126 having a central cavity 128 therein, a plurality of integrally formed teeth 130 on the lower end thereof and an elastomeric covering 132 thereon having, in turn, a plurality of wipers 134 thereon. The lower plug 124 comprises a non-metallic plastic body member 136 having a first bore 138 therein, a second bore 140 therein, a third bore 142 therein, a fourth bore 144 therein, a plurality of integrally formed teeth 146 and 147 thereon, an elastomeric covering 148 having a plurality of wipers 150 thereon, and non-metallic plastic insert member 152 retained in first bore 138 thereby securing diaphragm 154 in the body member 136 thereby blocking fluid flow through the bottom plug 124 during the well cementing process until the diaphragm 154 is ruptured by fluid pressure. The insert member 152 may be retained in first bore 138 by any suitable means, such as adhesive bonding, threaded engagement, etc.

Also shown in FIG. 4 is a typical non-metallic plastic plug seat insert 156 having integral teeth 158 formed thereon for use with the plug set 120 during cementing operations with a piece of cementing equipment 159. The teeth 158 on the plug seat insert 156 match the teeth 146 on the bottom plug 124, as well as teeth 130 of upper plug 122 so that when teeth 146 and 158 are engaged rotation of lower plug 124 with respect to the plug seat insert 156 is prevented. Similarly, when teeth 147 engage teeth 130 rotation of the lower plug 124 with respect to the upper plug 122 is prevented. The plug seat insert 156 may be used in any suitable cementing equipment, such as a float shoe, guide shoe, float collar, etc. Such typical types of cementing equipment are shown on pages 31 through 36 of Halliburton Services Sales and Service Catalog 44.

Figure 5:
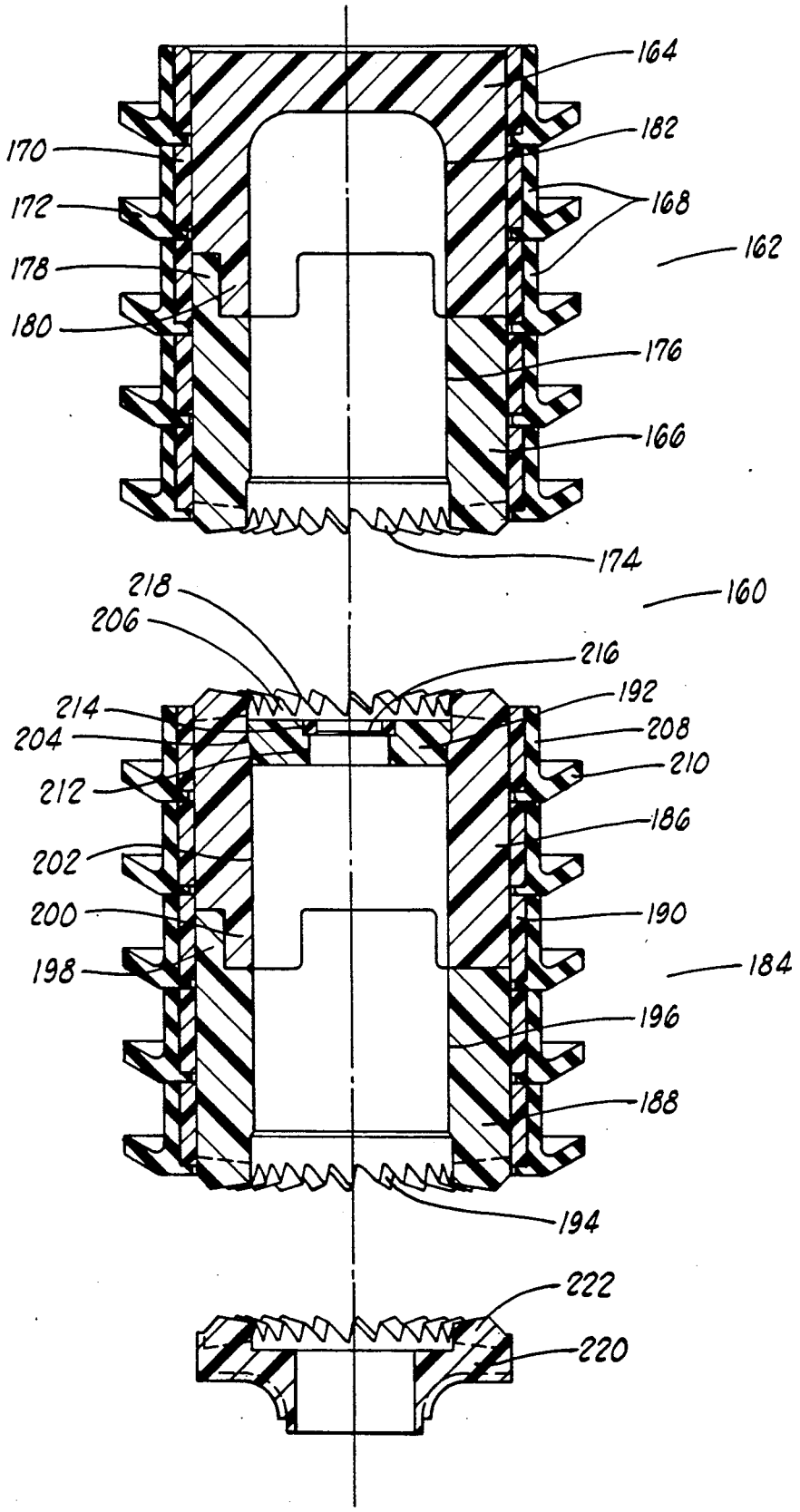
FIG. 5 is a cross-sectional view of another embodiment of the non-metallic, non-rotating plug set having integrally formed teeth thereon of the present invention.

Referring to FIG. 5, a second embodiment of the plug set 160 of the present invention is shown. The top plug 162 comprises upper and lower non-metallic, plastic plug body members 164 and 166 respectively and a plurality of wiper segments 168, each segment 168 Comprising an annular non-metallic plastic member 170 having an elastomeric covering with a wiper 172 thereon. The lower plug body member 166 is formed having integral teeth 174 on the lower end thereof, bore 176 therethrough, and a plurality of lugs 178 on the upper end thereof. The upper body member 164 is formed having a plurality of lugs 180 which mate with lugs 178 of the lower body member 166 and blind bore 182 therein.

The upper 164 and lower 166 body members are secured to each other by suitable adhesive bonding of the mating lugs 180 and 178 respectively to thereby form the upper plug 162. Each wiper segment 168 is secured to the upper plug 162 by suitable adhesive bonding of the annular non-metallic plastic member 170 to either the upper 164 or lower 166 body member.

The lower plug 184 of the plug set 160 comprises upper and lower non-metallic, plastic plug body members 186 and 188 respectively, a plurality of wiper segments 190 each segment comprising an annular non-metallic member 208 having an elastomeric covering with a wiper 210 thereon, and an insert baffle 192. The lower plug body member 188 is formed having integral teeth 194 on the lower end thereof, bore 196 therethrough and a plurality of lugs 198 on the upper end thereof. The upper body member 186 is formed having a plurality of lugs 200 which mate with lugs 198 of the lower body member 188, first bore 202, second bore 204 and a plurality of teeth 206 intergally formed on the upper end thereof which mate with teeth 174 of upper plug 162 of plug set 160.

The upper 186 and lower 188 body members are secured to each other by suitable adhesive bonding of the mating lugs 200 and 198 respectively to thereby form the lower plug 184. Each wiper segment 190 is secured to the lower plug 184 by suitable adhesive bonding of the annular non-metallic plastic member 208 to either the upper 186 or lower 188 body member.

The insert baffle 192 comprises an annular non-metallic, plastic member having an exterior surface which mates with first 202 and second 204 bores of upper plug body member 186 of lower plug 184, first bore 212, second bore 214, elastomeric baffle 216 which seals bores 212 and 214 preventing fluid flow therethrough and insert ring 218 which retains baffle 216 in insert baffle 192. The insert ring 218 is secured to the annular non-metallic, plastic member by any suitable means, such as adhesive bonding of the insert ring 218 in the bore 214, threaded engagement of the members, etc.

Also shown in FIG. 5 is a typical non-metallic plastic plug seat insert 220 having integral teeth 222 formed thereon for use with the plug set 160 during cementing operations with a piece of cementing equipment 223. The teeth 222 on the plug seat insert 220 match the teeth 194 on the bottom plug 184, as well as teeth 174 on upper plug 162, so that when teeth 194 and 222 are engaged rotation of the lower plug 184 with respect to the plug seat insert 220 is prevented. Similarly, when teeth 206 engage teeth 174 rotation of the lower plug 184 with respect to the upper plug 162 is prevented. The plug seat insert 220 may be used in any suitable cementing equipment, such as a float shoe, guide shoe, float collar, etc. Such typical types of cementing equipment are shown on pages 31 through 36 of Halliburton Services Sales and Service Catalog 44.

Figure 6:
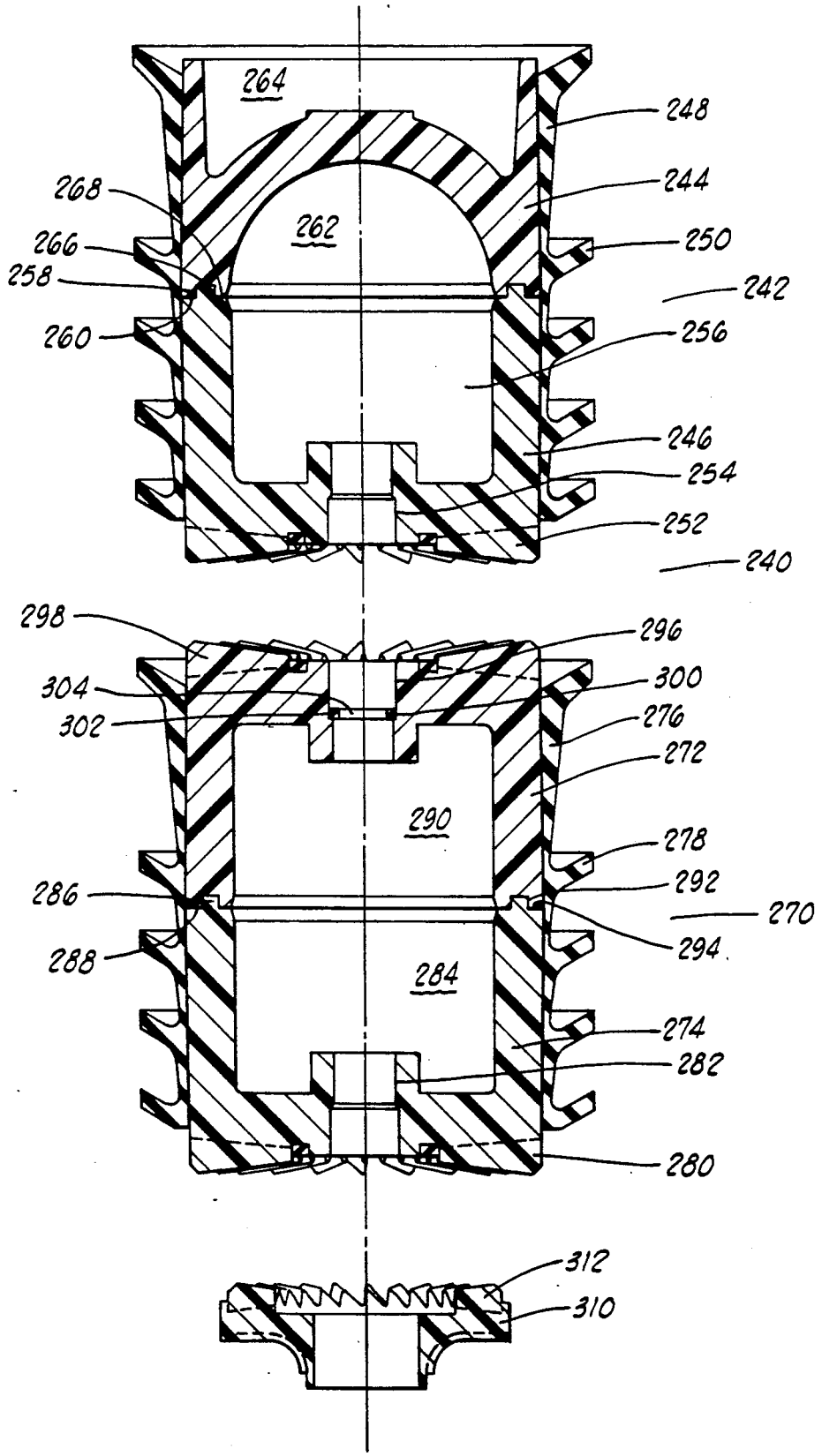
FIG. 6 is a cross-sectional view of another embodiment of the non-metallic, non-rotating plug set having integrally formed teeth thereon of the present invention.

Referring to FIG. 6, a third embodiment of the plug set 240 of the present invention is shown. The top plug 242 comprises upper and lower non-metallic, plastic plug body members 244 and 246 respectively and an elastomeric covering 248 having, in turn, a plurality of wipers 250 formed thereon.

The lower plug body member 246 is formed having integral teeth 252 on the lower end thereof, stepped bore 254 therein, cavity 256 and a plurality of integral circular pins 258 on the upper end surface 260 thereof.

The upper body member 244 is formed having lower 262 and upper 264 cavities therein and a plurality of apertures 266 in the lower end surface 268 thereof which mate with circular pins 258 of lower body member 246.

The upper 244 and lower 246 body members are secured to each other by suitable adhesive bonding of the mating pins 258 and apparatus 266 and surfaces 260 and 268 to thereby form the upper plug 242.

The bottom plug comprises upper and lower non-metallic, plastic plug members 272 and 274 respectively and an elastomeric covering 276 having, in turn, a plurality of wipers 278 formed thereon.

The lower plug body member 274 is formed having integral teeth 280 on the lower end thereof, stepped bore 282 therein, cavity 284 and a plurality of integral circular pins 286 on the upper end surface 288 thereof. The upper body member 272 is formed having cavity 290 therein, a plurality of apertures 292 in the lower end surface 294 which mate with circular pins 286 of lower body member 274, stepped bore 296 therein, and a plurality of integral teeth 298 on the upper end thereof which mate with teeth 252 of upper plug 242 to prevent rotation of the upper plug 242 with respect to lower plug 270 during cementing operations. The upper body member 272 further includes an insert baffle 300 retained within stepped bore 296. The insert baffle 300 comprises insert ring 302, and elastomeric baffle 304 which prevents fluid flow through stepped bore 296. The insert baffle 300 is secured in stepped bore 296 of the upper non-metallic plug member 272 by andy suitable means, such as adhesive bonding of the insert ring 302 in the stepped bore 296, threaded engagement of the insert ring 302 in the stepped bore 296, etc.

Also shown in FIG. 6 is a typical non-metallic plastic plug seat insert 310 having integral teeth 312 formed thereon for use with the plug set 240 during cementing operations with a piece of cementing equipment 313. The teeth 312 on the plug seat insert 310 match the teeth 280 on the bottom plug 270, as well as teeth 252 on upper plug 242, so that when teeth 280 and 312 are engaged rotation of the lower plug 270 with respect to the plug seat insert 310 is prevented. Similarly, when teeth 298 engage teeth 252 rotation of the lower plug 270 with respect to the upper plug 242 is prevented. The plug seat insert 310 may be used in any suitable cementing equipment, such as a float shoe, guide shoe, float collar, etc. Such typical types of cementing equipment are shown on pages 31 through 36 of Halliburton Services Sales and Service Catalog 44.

Referring to FIGS. 4 through 6 it can be easily seen that the plug sets 120, 160 and 240 of the present invention include upper and lower plugs having integrally formed teeth thereon which cooperatively engage during cementing operations to prevent rotation of the upper and lower plugs relative to each other as well as the plug set relative to a plug seat insert having teeth thereon which engage the integrally formed teeth o the bottom of the bottom plug of each plug set 120, 160 and 240 of the present invention. In this manner, since rotation of the upper and lower plugs with respect to each other is prevented and the rotation of the plug set with respect to the plug seat insert is prevented, drilling of the plug sets of the present invention is facilitated. Also, owing to their simplicity of design, the plug sets 120, 160 and 240 of the present invention are simple to manufacture thereby decreasing their cost.

OPERATION OF THE INVENTION

Referring to FIGS. 4 through 6, when it is desired to cement a string of casing into a well bore, the string of casing including a piece of cementing equipment, such as a float shoe, guide shoe, float collar, etc., having an insert seat having teeth thereon in the cementing equipment, the plug set 120, 160 and 240 of the present invention is used in the cementing process. During the cementing process the lower plug 124, 184 or 270 is pumped through the casing with the wipers on the plug wiping the drilling fluid from the interior of the casing string.

After the lower plug 124, 184 or 270 has landed on the insert seat having the integral teeth on the lower end of the lower plug engaging the teeth on the insert seat, the pressure of the cement being pumped behind the lower plug is increased until the pressure ruptures the elastomeric diaphragm of the insert baffle in the lower plug allowing cement to be pumped therethrough.

After a desired amount of cement has been pumped through the string of casing, lower plug and piece of cementing equipment having toothed insert seat therein, the upper plug of the plug set 120, 160 or 240 of the present invention is pumped through the casing having the wipers thereon wiping cement from the casing until the upper plug lands on the lower plug having the integrally formed teeth on the lower end of the upper plug engaging the integrally formed teeth on the upper end of the lower plug engaging each other.

After a suitable waiting period for the cement to set, a drill bit is then lowered through the string of casing to drill out the upper plug and lower plug of the plug set 120, 160 or 240 of the present invention.

It will be appreciated that since the integrally formed teeth of the upper and lower plugs of the plug sets 120, 160 and 240 of the present invention engage each other and the integrally formed teeth of lower plug engage the teeth of the plug seat insert, rotation of the plug set 120, 160 or 240 of the present invention is minimized during the drilling process thereby reducing the amount of drilling time required.

What is claimed is:

1. An anti-rotation plug set for use with cementing equipment having an insert seat therein, said anti-rotation plug set and said cementing equipment for use in cementing a string of casing into a well bore, said anti-rotation plug set comprising:

an upper plug including:

a non-metallic body member having a plurality of teeth integrally formed on the lower end thereof and an elastomeric covering thereon having, in turn, a plurality of wipers which engage the interior of said string of casing; and a lower plug including:

a non-metallic body member having a bore therethrough, having a plurality of teeth integrally formed on the upper end thereof which mate with the plurality of teeth integrally formed on the lower end of the non-metallic body member of the upper plug when the upper plug engages the lower plugs, having a plurality of teeth integrally formed on the lower end thereof, having an insert member in a portion of the bore through the non-metallic body member, the insert member including a frangible diaphragm therein, and having an elastomeric covering thereon having, in turn, a plurality of wipers which engage the interior of said string of casing;

and said cementing equipment comprising:

an insert seat having teeth thereon which mate with the integrally formed teeth on the lower end of the non-metallic body member of the lower plug of said anti-rotation plug set when the lower plug of said anti-rotation plug set engages said cementing equipment during said cementing of said string of casing into a well bore;

whereby when said string of casing is cemented into said well bore using said anti-rotation plug set with the integrally formed teeth on the non-metallic body member of the lower plug engage the teeth on the insert seat of said cementing equipment and the integrally formed teeth on the upper end of the lower plug engage the integrally formed teeth on the lower end of the upper plug, the drilling of said plug set is enhanced by said plug set being substantially prevented from rotation during drilling.

2. The anti-rotation plug set of claim 1 wherein:

the upper plug further includes:

a non-metallic body member formed of a plurality of pieces;

and the lower plug further includes:

a non-metallic body member formed of a plurality of pieces.

3. The anti-rotation plug set of claim 2 wherein:

the upper plug further includes:

each wiper of the elastomeric covering being secured to an annular non-metallic member which, in turn, is secured to a portion of the non-metallic body member;

and the lower plug further includes:

each wiper of the elastomeric covering being secured to an annular non-metallic member which, in turn, is secured to a portion of the non-metallic body member.

4. The anti-rotation plug set of claim 2 wherein:

the upper plug further includes:

a non-metallic body member formed of at least two pieces, each piece having at least one lug on one end thereof;

and the lower plug further includes:

a non-metallic body member formed of at least two pieces, each piece having at least on lug on one end thereof.

5. The anti-rotation plug set of claim 2 wherein:

the upper plug further includes:

a non-metallic body member formed of two pieces, one piece having a plurality of integral circular pins formed on one end thereof and the other piece having a plurality of holes formed in one end thereof whereby the plurality of pins formed in one end of one piece are received within the plurality of holes of the other body member when the two pieces are assembled;

and the lower plug further includes:

a non-metallic body member formed of two pieces, one piece having a plurality of integral circular pins formed on one end thereof and the other piece having a plurality of holes formed in one end thereof whereby the plurality of pins formed in one end of one piece are received within the plurality of holes when the other body member when the two pieces are assembled.

6. The anti-rotation plug set of claim 1 wherein the upper plug and the lower plug body members are formed of plastic.

* * * * *